US006529128B2

(12) United States Patent
Weng

(10) Patent No.: US 6,529,128 B2
(45) Date of Patent: Mar. 4, 2003

(54) SMART WIRELESS FIRE SITE NOTIFYING DEVICE

(75) Inventor: Linsong Weng, Chu-Pei (TW)

(73) Assignee: Hugewin Electronics Co., Ltd., Chu-Pei (TW)

( * ) Notice: Subject to any disclaimer, the term of this patent is extended or adjusted under 35 U.S.C. 154(b) by 143 days.

(21) Appl. No.: 09/846,213

(22) Filed: May 2, 2001

(65) Prior Publication Data

US 2002/0163428 A1 Nov. 7, 2002

(51) Int. Cl.[7] ..... G08B 1/08

(52) U.S. Cl. ..... 340/539; 340/506; 340/3.1; 340/3.2; 340/5.1; 340/825.36; 340/825.49

(58) Field of Search ..... 340/506, 531, 340/533, 288, 3.1, 3.2, 5.1, 825.36, 825.49, 825.52, 539

(56) References Cited

U.S. PATENT DOCUMENTS 4,389,639 A * 6/1983 Torii et al. ..... 340/531
4,673,920 A * 6/1987 Ferguson et al. ..... 340/531
5,189,394 A * 2/1993 Walter et al. ..... 340/506
5,252,775 A * 10/1993 Urano et al. ..... 340/506

* cited by examiner

*Primary Examiner*—Daryl Pope
(74) *Attorney, Agent, or Firm*—Rosenberg, Klein & Lee

(57) ABSTRACT

The present invention provides a smart wireless fire site notifying device, which comprises a plurality of fire sensors, a plurality of route indicators, and at least a remote control master. The fire sensor gives an alarm and outputs a wireless alarming signal to other fire sensors when detecting abnormal situations. The route indicator receives the wireless alarming signal, discriminates the signal, and determines and displays the fire site and the best escape route. The remote control master sets the address serial code of each fire sensor and mutual learning of digital codes of the fire sensors and the route indicators to let them receive the wireless alarming signal simultaneously. The present invention not only has learning and regular self testing functions, it can also inform the users of the fire site and situation and the best escape direction and route to exactly ensure their properties and safety.

12 Claims, 6 Drawing Sheets

SMART WIRELESS FIRE SITE NOTIFYING DEVICE

FIELD OF THE INVENTION

The present invention relates to a fire accident alarming system and, more particularly, to a smart fire site notifying device, which instantly informs preset users of the fire site and situation and the best escape direction and route through wireless transmission of signals to let them quickly escape from the fire site or hurry to fight the fire.

BACKGROUND OF THE INVENTION

Along with continual enhancement of safety consciousness of modern people, the safety requirement of living and working environments becomes higher and higher. However, there are still many events that cannot be controlled, wherein the fire accident is an unpredictable hazard. Many people lost their lives because of fire accidents. In fact, some fire accidents are avoidable, and if unavoidable, meaningless casualties can be prevented if the fire sources can be put out or people can escape from the fire sites in time once the fire accidents take place.

In large buildings such as office buildings, restaurants, and apartment buildings, fire sensors are usually disposed on the ceilings indoors to ensure the safety of users or inhabitants. The function of the fire sensor is to detect quick or abnormal increase of temperature. If the ambient temperature increases quickly or arrives at the set high temperature, the fire sensor will output an action signal to give an alarm so that people can quickly escape from the fire site.

However, in some large buildings, because there are so many rooms, once a fire accident takes place, people are unable to know the exact fire site, and there is no certain escape route. Therefore, the best escape opportunity is easily lost. Especially, in some office buildings or restaurants, because the users generally are temporary or short-term visitors or lodgers, even if they know there is a fire accident, they are unable to know the exact fire site and cannot escape from it in time because they are unfamiliar with the ambient environments, hence resulting in more casualties. Furthermore, because each product has its lifetime, the effect of a fire sensor will fall short because we cannot know whether the fire sensor operates normally. Therefore, the safety of users cannot be exactly ensured.

Accordingly, the present invention aims to propose a smart wireless fire site notifying device to resolve the above problems.

SUMMARY OF THE INVENTION

The primary object of the present invention is to provide a smart fire site notifying device, which instantly informs preset users of the fire site and situation and the best escape direction and route through wireless transmission of signals to let them quickly escape from the fire site or hurry to fight the fire, thereby reducing the danger to minimum.

Another object of the present invention is to provide a smart wireless fire site notifying device having learning function and capable of performing self test regularly to exactly ensure the safety of users.

Still another object of the present invention is to provide a smart wireless fire site notifying device having a fire accident automatic dialer, which can automatically report a case to the police at the same time when an alarm is given to evacuate people once a fire accident takes place.

Yet still another object of the present invention is to provide a smart wireless fire site notifying device having also emergency help-seeking function, wherein at least a caller disposed at dead places of a large building is exploited to achieve the function.

According to the present invention, a plurality of fire sensors are disposed in a large building, each fire sensor having a specific address serial code. A plurality of route indicators are disposed at walkways, and a plurality of emergency callers are disposed at dead places in the building. A remote control master is used to set the address serial code of each fire sensor in wireless way. Mutual learning and memorizing of the codes of all slaves such as the fire sensors, the route indicators, and the emergency callers are set to match the digital codes therein. When a fire sensor detects there is an abnormal situation, a wireless alarming signal is sent to the remote control master and other fire sensors and route indicators which have already learnt the digital codes to activate them.

The various objects and advantages of the present invention will be more readily understood from the following detailed description when read in conjunction with the appended drawings, in which:

DETAILED DESCRIPTION OF THE PREFERRED EMBODIMENTS

In the present invention, a smart fire site notifying device is disposed in a large building. The present invention uses the device to instantly inform users of the fire site and situation and the best escape direction and route through wireless transmission of signals to let them quickly escape from the fire site or hurry to fight the fire, thereby reducing the danger to minimum.

Figure 1:
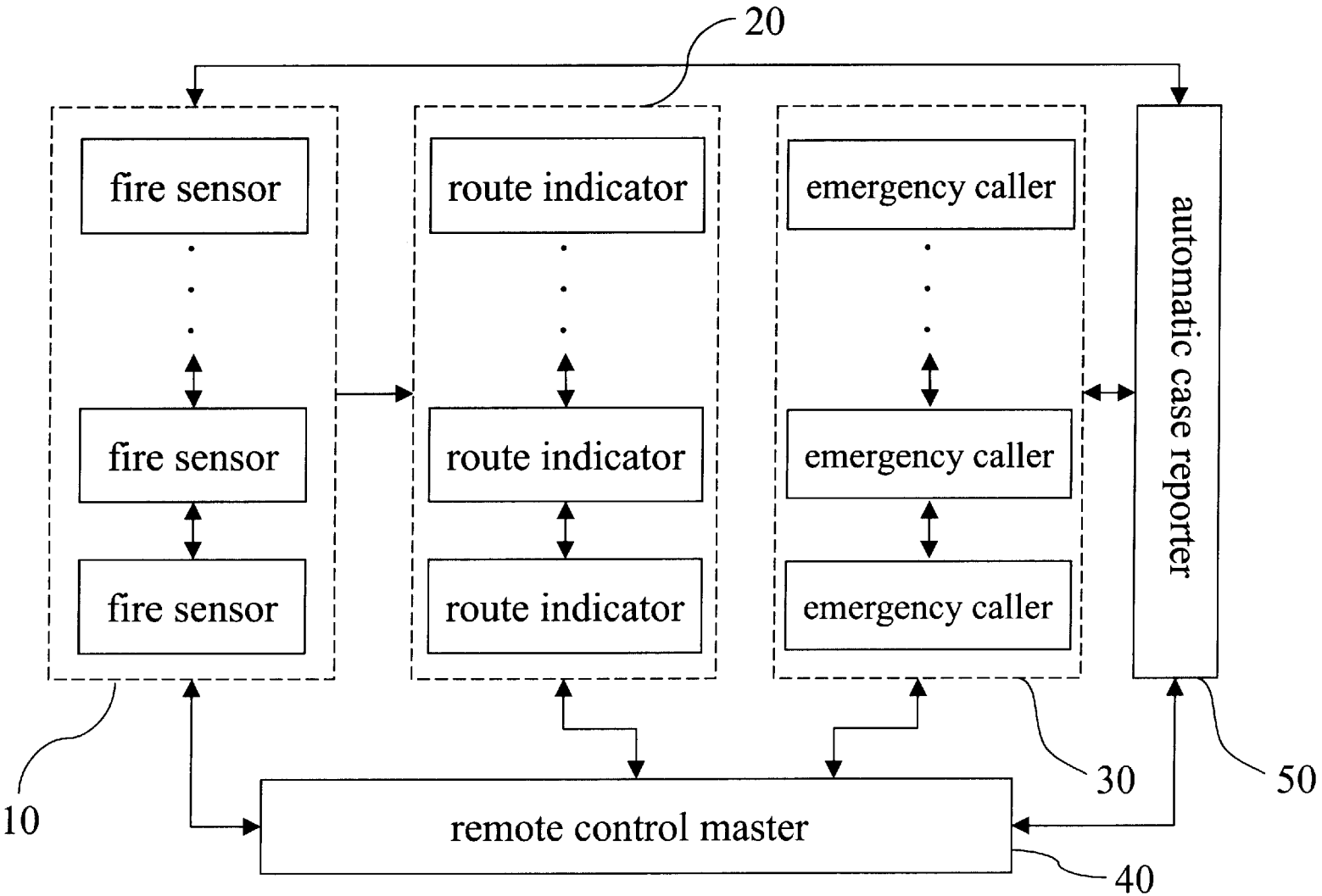
FIG. 1 is a structure block diagram of the present invention.

As shown in FIG. 1, in the present invention, a fire sensor 10 is disposed in each room in a large building. Each fire sensor 10 has a specific address serial code. A plurality of route indicators 20 are disposed at walkways and in public places. A plurality of wireless emergency callers 30 are disposed at dead places of safety such as stairways and parking lots in the large building. A remote control master 40 is used to set the address serial code of each fire sensor 10 in wireless way. Mutual learning and memorizing of the codes of all slaves such as the fire sensors 10, the route indicators 20, and the emergency callers 30 are set to match the digital codes therein. Therefore, when a fire sensor 10 detects there is an abnormal situation, it instantly gives an alarm and outputs a wireless alarming signal to the remote control master 40 and other fire sensors 10 and route indicators 20 which have already learnt the digital codes to let all the fire sensors 10 give voice alarms simultaneously. The route indicators 20 will discriminate from which fire sensor 10 is the signal sent according to the digital code when receiving the wireless alarming signal, and then determine the best escape route and simultaneously display the fire site and the escape route. Thereby, the users can escape from the fire site or hurry to fight the fire as quickly as possible according the guidance of the route indicators 20.

The smart wireless fire site notifying device further comprises an automatic case reporter 50, which learns the digital codes of other fire sensors 10 and emergency callers 30 through the remote control master 40. When the automatic case reporter 50 receives a wireless alarming signal from a fire sensor 10, it will automatically dial to the police and report the case with voice.

Additionally, when an emergency takes place, a user needs only to press an emergency caller 30, which will be instantly activated to encode and transfer the address and situation of the emergency caller 30 to the remote control master 40 or other receiving slaves that have already learnt the codes of situation.

The effects of the present invention will be illustrated below by describing in detail the structure of each part.

Figure 2:
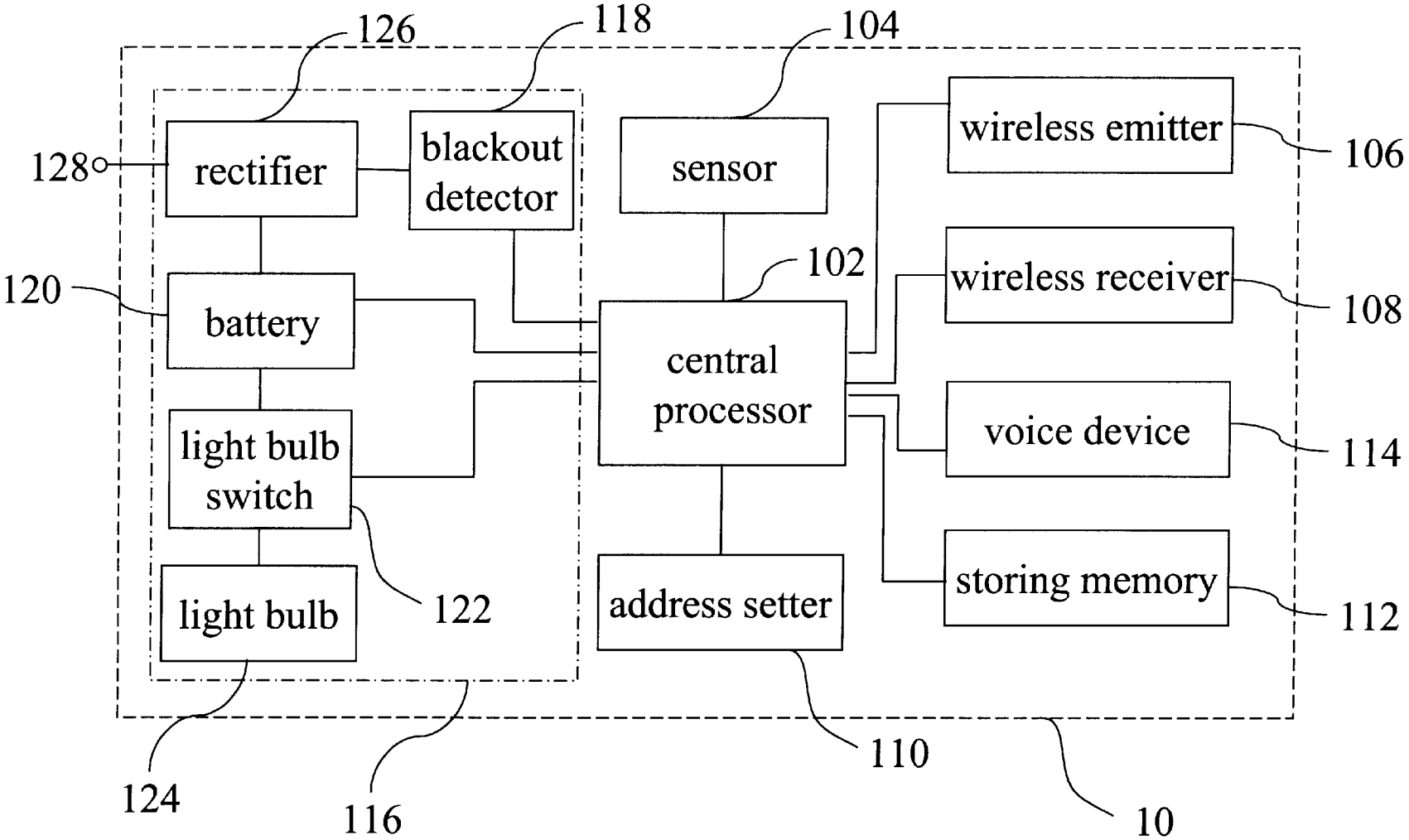
FIG. 2 is a structure block diagram of a fire sensor of the present invention.

As shown in FIG. 2, each fire sensor 10 comprises a central processor 102, a temperature and/or smoke sensor 104, a wireless emitter 106, a wireless receiver 108, an address setter 110, a storing memory 112, and a voice device 114. The central processor 102 is connected to the temperature and/or smoke sensor 104, the wireless emitter 106, the wireless receiver 108, the address setter 110, the storing memory 112, and the voice device 114. The central processor 102 receives address serial codes inputted from the address setter 110 and stores them into the storing memory 112, generally being an electrically erasable programmable read-only memory (EEPROM), and then receives and learns other different digital codes transmitted by the remote control master 40. The sensor 104 is used to detect abnormal situations such as quick and abnormal increase of temperature or smoke and then transmit out a notifying signal to the central processor 102. A wireless alarming signal is emitted out by the wireless emitter 106 to inform fire sensors of other preset addresses, and the voice device 114 then gives an alarm. Other fire sensors 10 use the wireless receivers 108 thereof to receive the wireless alarming signal, transfer it to the central processor 102 thereof to discriminate the address code of the signal and judge the fire site and situation and the most proper escape direction, and then give alarms and some points for attention using the voice devices 114 thereof to inform the users.

Additionally, to avoid the situation of blackout, each fire sensor 10 has an emergency illumination device 116, which comprises a blackout detector 118, a battery 120, a light bulb switch 122, a light bulb 124, and a rectifier 126. The blackout detector 118, the battery 120, and the light bulb switch 122 are connected to the central processor 102. The light bulb 124 is connected to the light bulb switch 122. The rectifier 126 is connected to an AC power input terminal 128, the blackout detector 118, and the battery 120. Ordinarily, electricity is transferred from the AC power input terminal 128 via the rectifier 126 and then stored in the battery 120. When the blackout detector 118 detects that blackout occurs, the light bulb switch will be turned on by the central processor 102. The battery 120 will then provide electricity for the light bulb 124 used as an emergence illumination.

Figure 3:
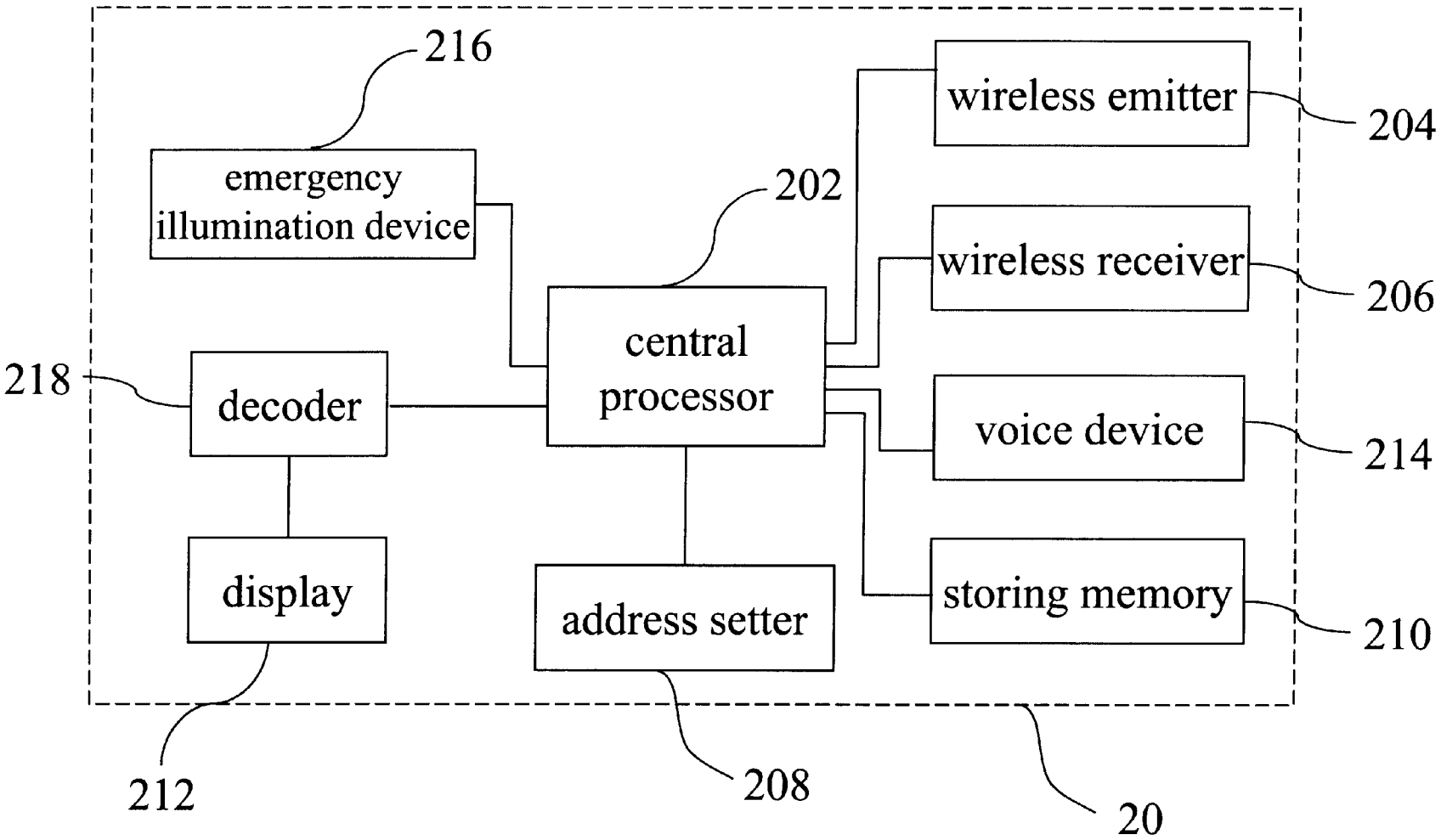
FIG. 3 is a structure block diagram of a route indicator of the present invention.

As shown in FIG. 3, the route indicator 20 disposed in a public place to guide the users comprises a central processor 202, a wireless emitter 204, a wireless receiver 206, an address setter 208, a storing memory 210, a display 212, a voice device 214, an emergency illumination device 216, and a decoder 218. The central processor 202 is connected to the wireless emitter 204, the wireless receiver 206, the address setter 208, the storing memory 210, the display 212, the voice device 214, and the emergency illumination device 216. The central processor 202 receives address serial codes of the fire sensors 10 inputted from the address setter 208, and stores them into the storing memory 210. When the wireless receiver 206 receives a wireless alarming signal from a fire sensor 10, from which fire sensor is the signal emitted out and the best escape route are determined through the processing of the internal program of the central processor 202. The decoder 218 is then used to let the display 212 show the fire site and the escape route. The voice device 214 then emits the voice prerecorded therein to inform nearby people of the escape direction or the direction to fight the fire. The structure and effect of the emergency illumination device 216 are the same as those of the emergency illumination device 116 of the fire sensor 10 and thus will not be further described.

Figure 4:
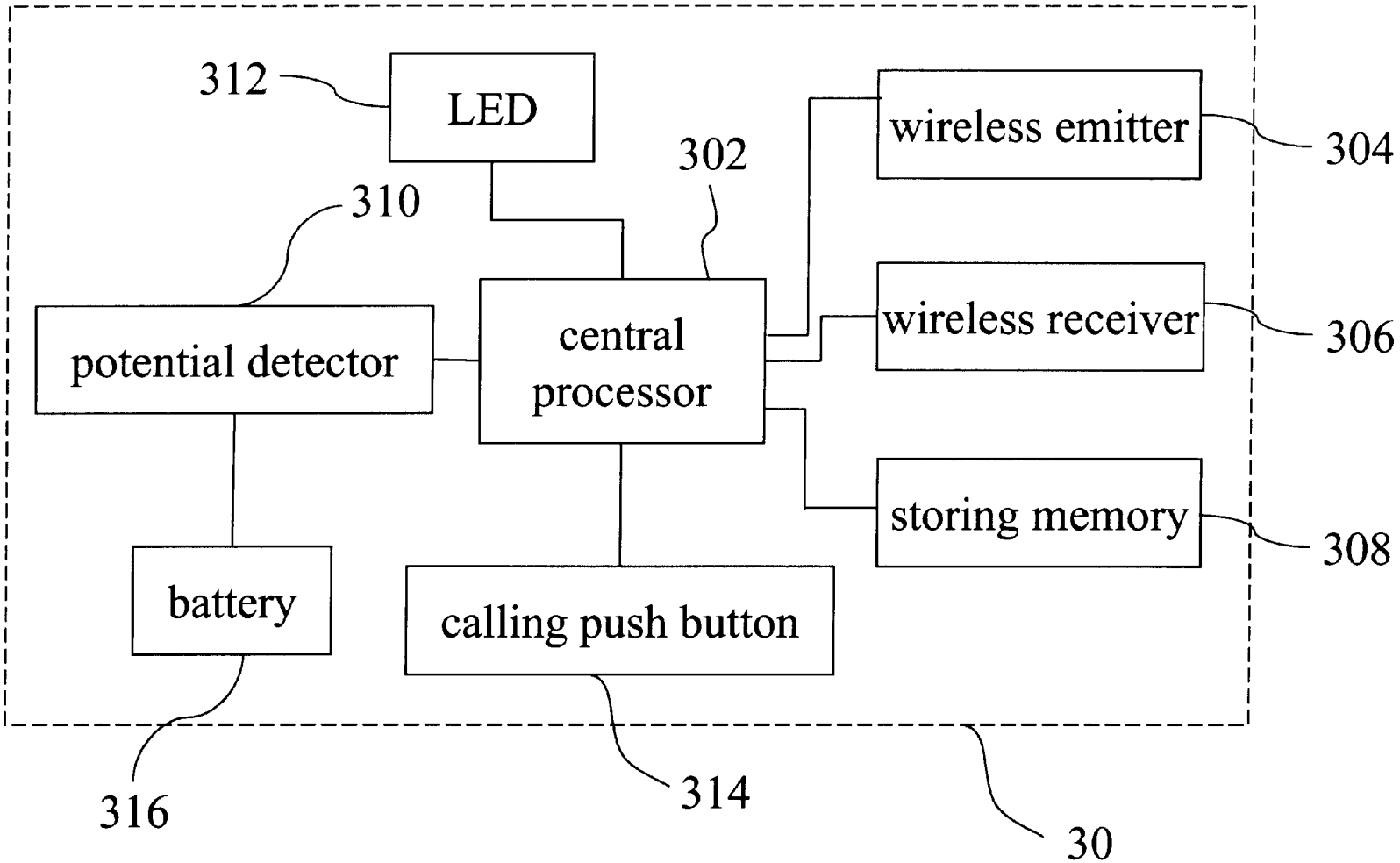
FIG. 4 is a structure block diagram of an emergency caller of the present invention.

As shown in FIG. 4, the wireless emergency caller 30 comprises a central processor 302, a wireless emitter 304, a wireless receiver 306, a storing memory 308, a potential detector 310, a light emitting diode (LED) 312, a calling push button 314, and a battery 316. The central processor 302 is connected to the wireless emitter 304, the wireless receiver 306, the storing memory 308, the potential detector 310, the LED 312, and the calling push button 314. The battery 316 provides the required electricity. The wireless receiver 306 is used to receive the individual address serial code of the remote control master 40, to learn other preset digital codes, and to store them into the memory 308. The potential detector 310 is used to detect whether there is enough electricity in the battery 316. When an emergency takes place, a user needs only to press the calling push button 314. The central processor 302 in the caller 30 will be instantly activated to transfer and encode the address and situation of the emergency caller 30 to the remote control master 40 or other slaves which have already learnt the codes of situation, thereby calling other people to come and help. At this time, the LED 312 can be turned on simultaneously.

Figure 5:
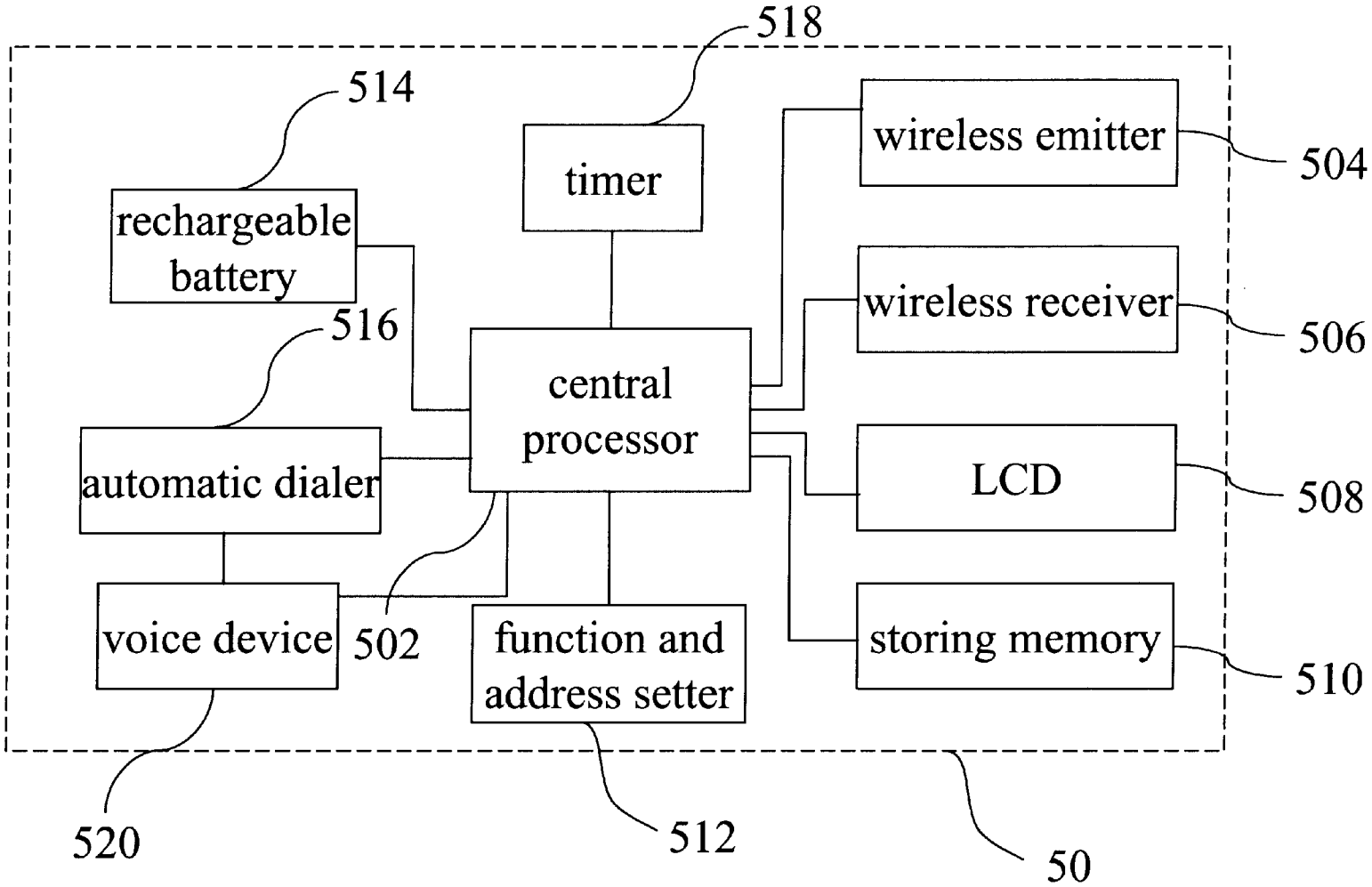
FIG. 5 is a structure block diagram of an automatic case reporter of the present invention.

As shown in FIG. 5, the automatic case reporter 50 comprises a central processor 502, a wireless emitter 504, a wireless receiver 506, a liquid crystal display (LCD), a storing device 510, a function and address setter 512, a rechargeable battery 514, a fire accident automatic dialer 516, a voice device 520, and a timer 518. When a fire accident occurs, a wireless alarming signal received by the wireless receiver 506 will be transferred to the central processor 502, the automatic dialer 516 will then be controlled by the central processor 502 to automatically telephone the police, and the voice device 520 will automatically report the case with voice. Additionally, when the whole smart wireless fire site notifying device performs self system test regularly, the fire sensors 10 will be automatically activated to test signals. The timer 518 in the automatic case reporter 50 is used to tell time for recording the occurring time of the fire accident when the voice device 520 reports the case to the police with voice.

Figure 6:
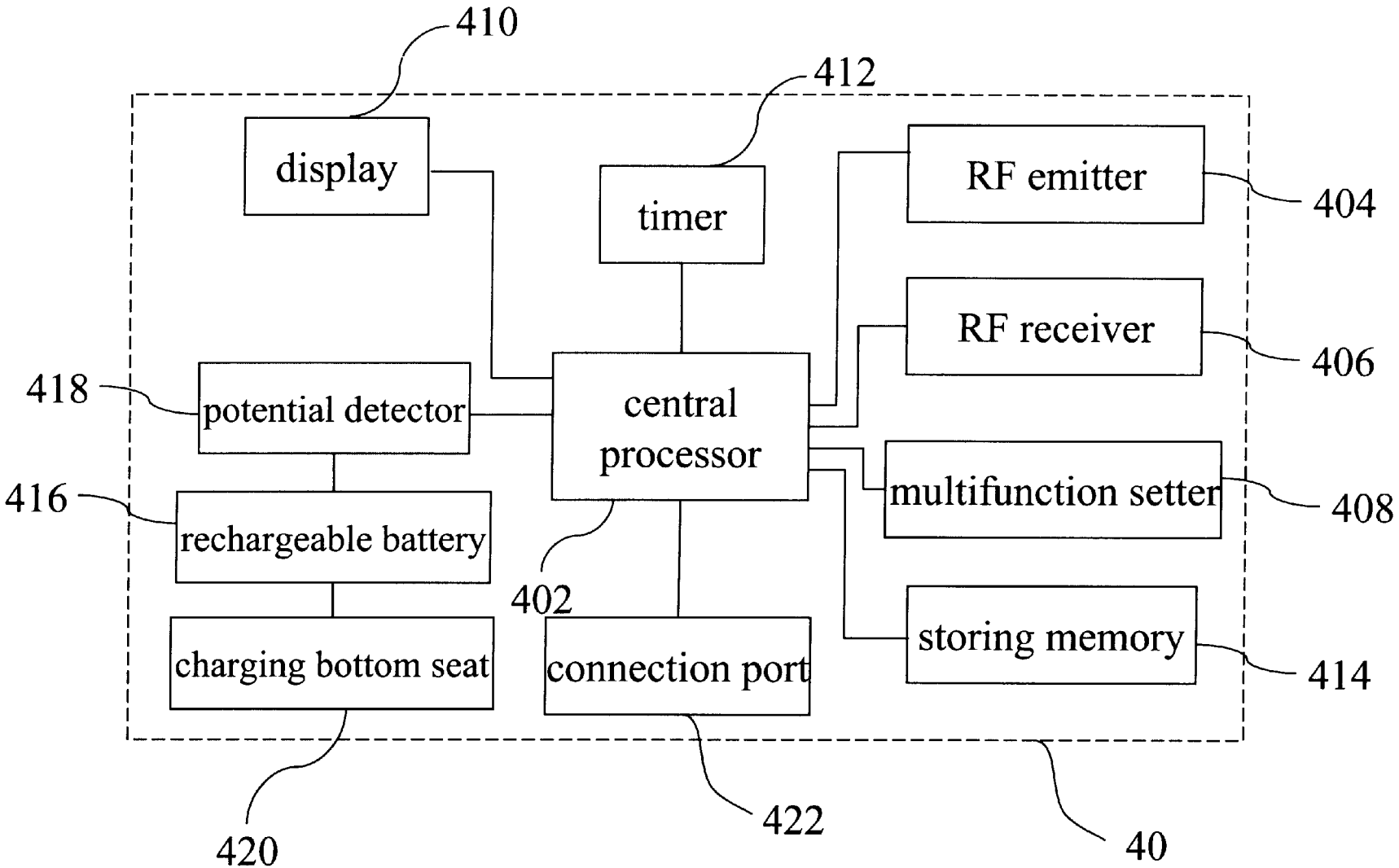
FIG. 6 is a structure block diagram of a remote control master of the present invention.

All the above slaves use the remote control master 40 to learn the settings mutually. As shown in FIG. 6, the remote control master 40 comprises a central processor 402, a radio-frequency (RF) emitter 404, an RF receiver 406, a multifunction setter 408, a display 410, a timer 412, a storing memory 414, a rechargeable battery 416, a potential detector 418, a charging bottom seat 420, and a connection port 422. The central processor 402 is connected to the RF emitter 404, the RF receiver 406, the multifunction setter 408, the display 410, the timer 412, the storing memory 414, the potential detector 418, and the connection port 422. The central processor 402 receives data and address serial codes inputted from the multifunction setter 408, displays them on the display 410, and stores them into the storing memory 414. The central processor 402 also uses the RF emitter 404 and the RF receiver 406 to set mutual learning of the serial codes of all slaves such as the fire sensors 10, the route indicators 20, the emergency callers 30, and the automatic case reporter 50 so that the wireless alarming signal or the digital code of situation emitted by a fire sensor 10 or an emergency caller 30 can call each slave having learnt the digital code. Thereby, the smart wireless fire site notifying device can work fast. Additionally, a cancel button is preset on the multifunction setter 408. If the alarm is to be canceled, it is only necessary to press the cancel button on the multifunction setter 408 to let the central processor 402 transfer a cancel signal to all the slaves such as the fire sensors 10, the route indicators 20, the emergency callers 30, or the automatic case reporter 50 to deactivate them.

The multifunction setter 408 of the remote control master 40 is used to set the addresses of the fire sensors 10 or the emergency callers 30. The central processor 402 matches the function of the timer 412 to send out test signals of the whole system regularly to ensure normal operation of each slave. The regular test signals combine the address of each slave for testing. When the set testing time arrives each day, the remote control master 40 will send out a test signal. When the slaves such as the fire sensors 10 and the emergency callers 30 receive the signal, they will respond using the central processors therein. When the test is finished, the central processor in each slave will combine the test result and status to send a complete response signal back to the remote control master 40, which will record the results into the system. The rechargeable battery 416 is used to provide the required electricity for each part. The potential detector 418 is connected between the rechargeable battery 416 and the central processor 402 to detect whether there is enough electricity in the rechargeable battery 416. To increase convenience of the remote control master 40, the charging bottom seat 420 is provided for charging the rechargeable battery 416.

The connection port 422 is also provided and connected between the remote control master 40 and a computer for real-time monitoring.

To sum up, the smart fire site notifying device of the present invention not only has learning and regular self testing functions, it can also inform the users of the fire site and situation and the best escape direction and route to exactly ensure their properties and safety.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A smart wireless fire site notifying device comprising:

a plurality of fire sensors each having an address serial code, each said fire sensor providing an audible alarm and wirelessly outputs an alarming signal including said address serial code responsive to detecting a predetermined abnormal condition, a predetermined portion of said plurality of fire sensors outputting an audible alarm responsive to receipt of said alarming signal from a predetermined at least one other of said plurality of fire sensors;

a plurality of route indicators respectively located remote from said plurality of fire sensors, each of said plurality of route indicators including a receiver for receiving said alarming signal, each said route indicator discriminating said address serial code from said alarming signal to identify said fire sensor outputting said alarming signal, each said route indicator including means for determining a best escape route and a display for displaying a location of said fire sensor outputting said alarming signal and said best escape route; and a remote control master located remote from said plurality of fire sensors and said plurality of route indicators, said remote control master including means for wirelessly setting address serial codes of said fire sensors and transferring address serial codes of predetermined fire sensors to others of said plurality of fire sensors and said route indicators so that they can simultaneously respond to said alarming signal output by a respective fire sensor.

2. The device as claimed in claim 1, wherein each said fire sensor comprises a central processor connected to a sensor, a wireless emitter coupled to said central processor, a wireless receiver coupled to said central processor for receiving said alarming signal from at least another of said fire sensors, an address setter coupled to said central processor, a storing memory coupled to said central processor, and a voice device coupled to said central processor, said central processor receiving address serial codes input from said address setter and stores them in said storing memory, said sensor being adapted to detect said predetermined abnormal condition and output a notifying signal to said central processor, said central processor providing an output to said wireless emitter for output of said alarming signal and another output to said voice device for output of said audible alarm.

3. The device as claimed in claim 2, wherein each said fire sensor further includes an emergency illumination device for providing light responsive to a power failure.

4. The device as claimed in claim 3, wherein said emergency illumination device comprises a blackout detector, a battery, and a light bulb switch connected to said central processor of said fire sensor, said light bulb switch being connected to a light bulb, said emergency illumination device further having a rectifier connected to an AC power input terminal and said blackout detector, said central processor turning on said light bulb switch and said battery providing the required electricity to turn on said light bulb when said blackout detector detects there is a blackout.

5. The device as claimed in claim 1, wherein each said route indicator comprises a central processor connected to a wireless emitter, a wireless receiver coupled to said central processor for receiving said alarming signal from at least one of said fire sensors, an address setter coupled to said central processor, a storing memory coupled to said central processor, and a voice device coupled to said central processor, said display being coupled to said central processor, said central processor receiving address serial codes of said fire sensors input from said address setter and stores them in said storing memory, said central processor providing an output to said voice device to output an audible voice message corresponding to said best escape route responsive to said receipt of said alarming signal.

6. The device as claimed in claim 5, wherein each said route indicator further includes an emergency illumination device for providing light responsive to detection of a power failure.

7. The device as claimed in claim 6, wherein said emergency illumination device comprises a blackout detector, a battery, and a light bulb switch connected to said central processor of said fire sensor, said light bulb switch being connected to an illumination lamp, said emergency illumination device further having a rectifier connected to an AC power input terminal and said blackout detector, said central processor turning on said light bulb switch and said battery providing the required electricity to turn on said illumination lamp when said blackout detector detects there is a blackout.

8. The device as claimed in claim 1, wherein said remote control master comprises a central processor connected to a radio-frequency emitter, a radio-frequency receiver coupled to said central processor for receiving said alarming signal from at least one of said fire sensors, a multifunction setter coupled to said central processor, a display coupled to said central processor, a timer coupled to said central processor, and a storing memory coupled to said central processor, said central processor receiving data and address serial codes input from said multifunction setter for display on said display and storage in said storing memory, said central processor outputting address serial codes to said radio-frequency emitter and receiving transmitted address serial codes from said radio-frequency receiver of said fire sensors and said route indicators, said central processor receiving time signals from said timer to periodically send out a test signal and thereby ensure normal operation of each said fire sensor and each said route indicator, said remote control master also having a battery for providing power.

9. The device as claimed in claim 8, wherein said remote control master further has a computer connection port connected to said central processor.

10. The device as claimed in claim 8, wherein said remote control master includes a charging bottom seat for charging said battery.

11. The device as claimed in claim 1 further comprising at least one emergency caller manually operable for transferring an address and situation signal to said remote control master.

12. The device as claimed in claim 1 further comprising an automatic case reporter adapted for automatically telephoning of a police agency and providing a voice report responsive to receipt of said wireless alarming signal.

* * * * *